US006510801B2

(12) United States Patent
Tan

(10) Patent No.: US 6,510,801 B2
(45) Date of Patent: Jan. 28, 2003

(54) PALLET FOR SHRINKWRAPPED PACKAGING OF BLOCK RUBBER

(76) Inventor: Hong Sin Tan, Blk 328 Yishun Ring Road, #11-1368, Singapore 760328 (SG)

( * ) Notice: Subject to any disclaimer, the term of this patent is extended or adjusted under 35 U.S.C. 154(b) by 0 days.

(21) Appl. No.: 09/872,322

(22) Filed: Jun. 1, 2001

(65) Prior Publication Data

US 2002/0178973 A1 Dec. 5, 2002

(51) Int. Cl.[7] ..... B65D 19/38
(52) U.S. Cl. ..... 108/53.3; 108/57.25
(58) Field of Search ..... 108/53.1, 53.3, 108/53.5, 54.1, 55.5

(56) References Cited

U.S. PATENT DOCUMENTS

| | | | | |
|---|---|---|---|---|
| 1,814,252 A | * | 7/1931 | Leary | |
| 3,167,341 A | | 1/1965 | Higgins | 294/67 |
| 3,212,807 A | * | 10/1965 | Luchford et al. | |
| 3,433,184 A | | 3/1969 | Addy | 108/53 |
| 3,478,995 A | * | 11/1969 | Lautzenhiser et al. | |
| 3,680,495 A | | 8/1972 | Pike | 108/53 |
| 3,753,407 A | * | 8/1973 | Tilseth | |
| 3,874,546 A | | 4/1975 | Sanders et al. | 220/6 |
| 4,674,647 A | | 6/1987 | Gyenge et al. | 220/6 |
| 5,549,341 A | * | 8/1996 | Chase et al. | |
| 6,276,285 B1 | * | 8/2001 | Ruch | |
| 6,327,984 B1 | * | 12/2001 | McCann et al. | |

FOREIGN PATENT DOCUMENTS

DE 4102985 A1 * 8/1992

OTHER PUBLICATIONS

Shrinkpackaging of SMR—Guide For Producers (1984), "Specifications", 1–15 and 111.

Papers Presented at the International Rubber Forum—"Recent Developments in the Packaging of Natural Rubber", Hamburg Sep./Oct. 1987, # 67–70.

Guidelines for SMR Producers—"Treatment of Wood", 2 pages.

* cited by examiner

*Primary Examiner*—Jose V. Chen
(74) *Attorney, Agent, or Firm*—Brown & Michaels, PC

(57) ABSTRACT

A pallet includes a plurality of hinges having a flip member which is easily rotated by hand between a first unextended position and a second extended position. When the flip member is flipped into the unextended position, it uncovers a cavity a pallet leg creates. Nesting of an empty pallet is possible when the flip members are in this position. Bar members preferably serve as a guide and glide the receiving pallet to slide in position during the nesting process. The pallet is stackable when the flip members are flipped into an extended position, covering up the leg cavities. Each of the hinges acts as a foot to support members of the receiving pallet. The pallet platform is preferably made of a sheet of metal. An angular bar member is preferably attached to the rectangular framework and serves as a border for the pallet. Holes are preferably found within the angular bar member. These holes allow manual lifting of the pallet using hooks. Rings at the base of the rectangular framework preferably allow rubber blocks to be strapped across the pallet from both sides. The whole pallet is preferably galvanized for use in packaging rubber blocks.

20 Claims, 5 Drawing Sheets

PALLET FOR SHRINKWRAPPED PACKAGING OF BLOCK RUBBER

BACKGROUND OF THE INVENTION

1. Field of the Invention

The invention pertains to the field of pallets. More particularly, the invention pertains to metal pallets for packaging rubber blocks.

2. Description of Related Art

Wooden crates and wooden pallet bases have traditionally been used to package rubber blocks. In shrinkwrapped packaging, rubber bales are arranged and placed on the wooden pallet base (platform) and are pressed down to a pre-set level with the aid of a metal plunger and a metal performer. When the bale consolidation is completed, a polythene shrink film is placed over the rubber extending down to the upper portion of the pallet base. The pallet is held together tightly by the polythene shrink film. However, there are many problems associated with timber base packaging including contamination by wooden splinters. Also, the increasing cost of wooden pallets due to a shortage of timber in producing countries makes it difficult to obtain timber to build the pallet. The most serious problem lies in the disposal of pallet timber, which has become increasingly costly. This problem mainly affects consumers in developed countries. While wooden pallets allow stacking, they are difficult to nest. Height is a critical factor in determining the number of pallets that can be loaded into a 20-foot container for a return journey, and wooden pallets are not cost efficient for a return journey.

There have been a number of pallets patented in the past.

U.S. Pat. No. 3,167,341, "NESTABLE SHIPPING PALLETS", Higgins (1965), describes a metal nesting pallet. The pallet does not have hinge supports.

U.S. Pat. No. 3,433,184, "NESTABLE PALLETS", Addy (1969), shows a molded plastic pallet capable of nesting. The pallet does not have hinge supports.

U.S. Pat. No. 3,680,495, "PALLET STRUCTURE", Pike (1972), describes a pallet structure in the form of a grid, with feet extending below to make room for lift truck forks. The pallets can nest by putting the feet of an overlying pallet into the feet of a lower one. The pallet is made of plastic and does not have hinge supports.

U.S. Pat. No. 3,847,546, "CONVERTIBLE CONTAINER-PALLET", Sanders et al (1975), presents a plastic pallet with low side walls that hinge into the base. When the walls are up, the pallet forms a stacking container and when the walls are down, it is a flat pallet.

U.S. Pat. No. 4,674,647, "COLLAPSIBLE STORAGE BIN", Gyenge et al. (1987), describes a pallet type container made of molded plastic. The pallet nests when stacked in the erected or collapsed mode. The side and end walls of the container pivot to the pallet base means of integrally molded snap-fitting hinges.

In addition, the Malaysian Rubber Board (MRB) has developed a metal pallet that allows nesting but not stacking. This pallet has more than four legs in various positions and a wire mesh platform. The pallet also has a metal strip border that runs along the side of the rectangular tube framework. The nesting height (dead height) between two pallets is made up of the height of the metal strip and the height of the rectangular tube framework. A major drawback of this design is a narrow nesting gap between nested pallets. This creates a major problem if one tries to retrieve an empty pallet. One has to start from the very top pallet because there are no other means to retrieve these pallets, except perhaps by introducing a hook retrieval method. However, there is no apparatus such as hook holes, half moon rings, or O-rings on the pallet to allow for retrieval via hooks. Also, the dead height limits the number of pallets that can be loaded in a 20-foot container for a return journey, thereby resulting in a higher transportation cost per pallet unit. Another drawback relates to the nesting of empty pallets. Although there is no problem when empty pallets are nested manually to chest height (about 20 pallets), a problem arises when one tries to nest 45 pallets in single stack. A single stack of 45 pallets is equivalent to the height of a 20-foot container. Also, the Malaysian Rubber Board pallet was not designed for forklift truck operation. The flimsy flat metal strip border is easily damaged by the force of a forklift truck blade. In addition, the wire mesh platform requires additional packaging materials such as a piece of cardboard or a thick polythene sheet on top of the wire mesh to prevent the rubber from falling out of the large square openings.

Therefore, there is a need in the art for a recyclable nesting and stacking pallet for the transportation of rubber blocks.

SUMMARY OF THE INVENTION

The preceding and other shortcomings of the prior art are addressed and overcome by the present invention. A pallet for stacking and nesting includes a plurality of hinged flip members and an angular bar member that conceals the rectangular tube framework. The pallet is preferably used to transport rubber blocks. Alternatively, it is used for bulk transport of any non-perishable cargo. The hinge contributes to the easy nesting and stacking process. In addition, the angular bar member on top of the rectangular framework serves as a border to conceal the height of the rectangular tube and thus maximize the return of pallets. The novel pallet allows both nesting and stacking and ensures the maximization of the returning pallet.

In a preferred embodiment, the pallet includes a plurality of hinges having a flip member which is easily rotated by hand between a first unextended position and a second extended position. When the flip member is flipped into the unextended position, it uncovers a cavity a pallet leg creates. Nesting of an empty pallet is possible when the flip members are in this position. Bar members preferably serve as a guide and glide the receiving pallet to slide in position during the nesting process. The pallet is stackable when the flip members are flipped into an extended position, covering up the leg cavities. Each of the hinges acts as a foot to support members of the receiving pallet. The pallet platform is preferably made of a sheet of metal. An angular bar member is preferably attached to the rectangular framework and serves as a border for the pallet. Holes are preferably found within the angular bar member. These holes allow manual lifting of the pallet using hooks. Rings at the base of the rectangular framework preferably allow rubber blocks to be strapped across the pallet from both sides. The whole pallet is preferably galvanized for use in packaging rubber blocks.

DETAILED DESCRIPTION OF THE INVENTION

Figure 1:
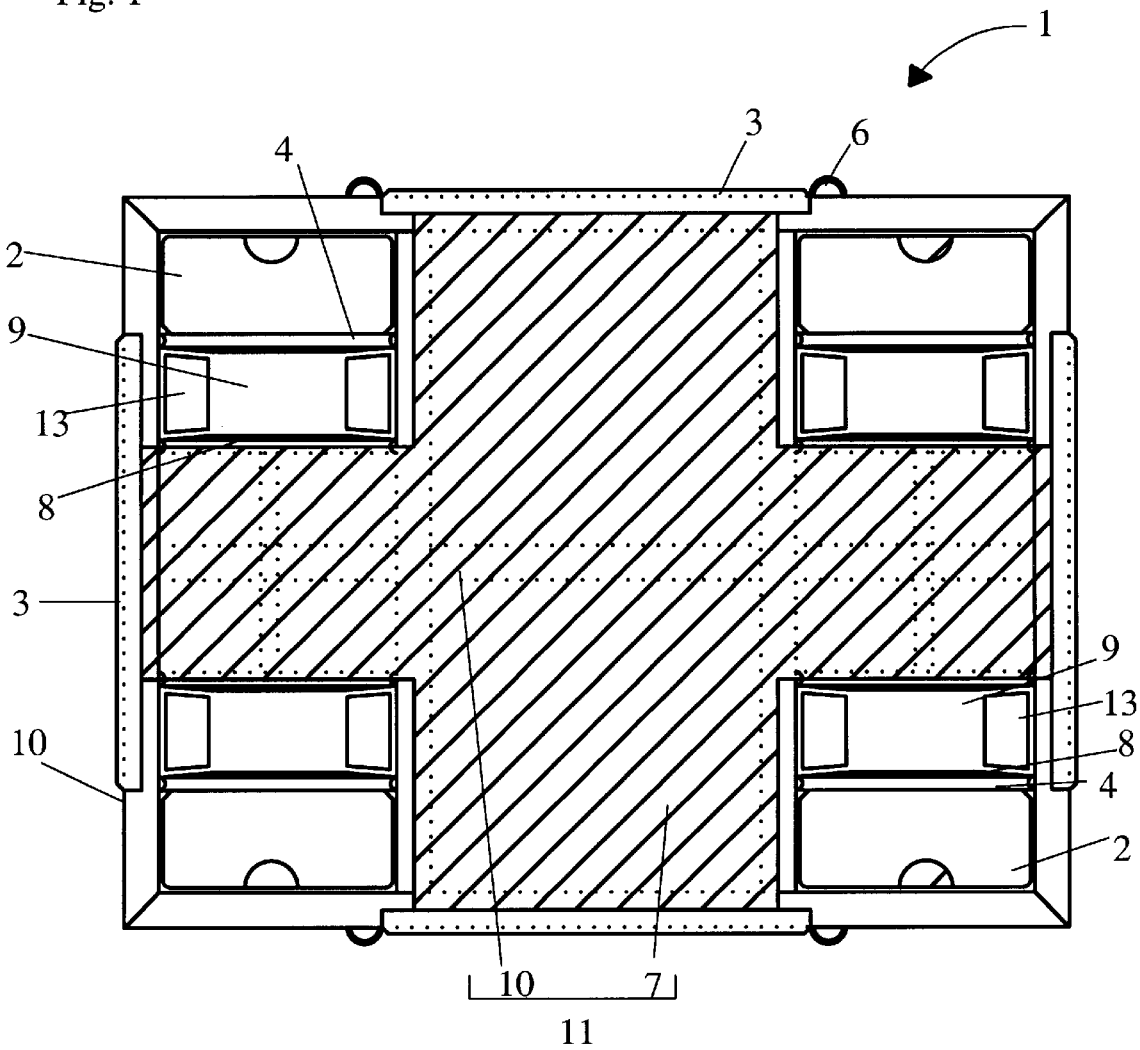
FIG. 1 shows a preferred embodiment of the pallet in a nesting configuration.

To assist in a better understanding of the present invention, a specific embodiment of the invention will now be described in detail. Although such is the preferred embodiment, it is to be understood that the invention can take other embodiments. This detailed description of the invention will include reference to FIGS. 1 through 9. The same reference numerals will be used to indicate the same parts and locations in all the figures unless otherwise indicated. It will be apparent to one skilled in the art that the present invention may be practiced without some of the specific details described herein. In other instances, well-known structures and devices are shown in block diagram form.

Figure 8:
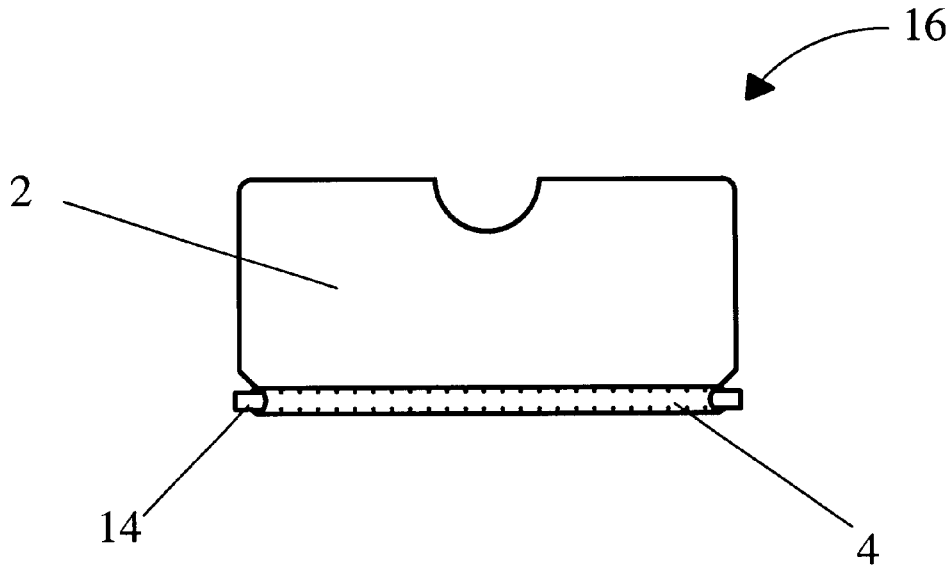
FIG. 8 shows a hinge of the present invention.

Referring to FIGS. 1 and 8, a pallet (1) of the present invention preferably has a plurality of hinges (16) which include a flip member (2) and a hollow bar member (4) housing a solid bar (14). The hollow bar member (4) is preferably a hollow tube or pipe. Although the flip member (2) is rectangular in the drawings, it can be any shape. The hollow bar member (4) is preferably welded together with the flip member (2). FIG. 1 shows a hinge (16) in each of the corners of the pallet (1). The flip member (2) of the hinge (16) is easily rotated by hand. The hinge (16) is preferably composed of rounded bars or rods, strips of flat bars, or other lightweight materials, for example plastics, plywood, cardboard or aluminum. A preferred material for the pallet including the hinge (2) is mild steel because it is inexpensive and easy to fabricate. The completed pallet (1) is preferably galvanized.

When the flip member (2) is rotated towards the corners of the pallet (1) and is in an unextended position, a cavity (9) is uncovered. Although the flip member (2) is rotated towards the corners in FIG. 1, it could also be rotated in other directions, including towards the center of the pallet (1), depending on the position of the hinge (16). Each cavity (9) is created by a leg (8). The cavities (9) formed may have any shape, including a channel shape. Although there are four hinges (16), four legs (8) and four cavities (9) depicted in the figures, any number of each of these elements is possible in any configuration. The position of the legs (8) in the figures allows four way entry for forklifts across the width and length without having to change the position of the forklift blades. The legs (8) have a preferable thickness from 3.0 to 5.0 mm. In a preferred embodiment, the legs (8) are taper-shaped. The legs (8) are preferably reinforced by two "U" channels (13) welded to each side of the legs (8) for added strength. The curvature of the "U" channels (13) serve to deflect the rounded tip of a forklift truck blade so that the forklift truck blade can move in position for easy lifting.

In an alternative embodiment, disposable hinges (2) are used. Disposable hinges are throw-away materials that are used to cover the leg cavity (9) in a stacking configuration (see FIG. 2). For example, extension members are slid to cover the cavity (9).

Figure 3:
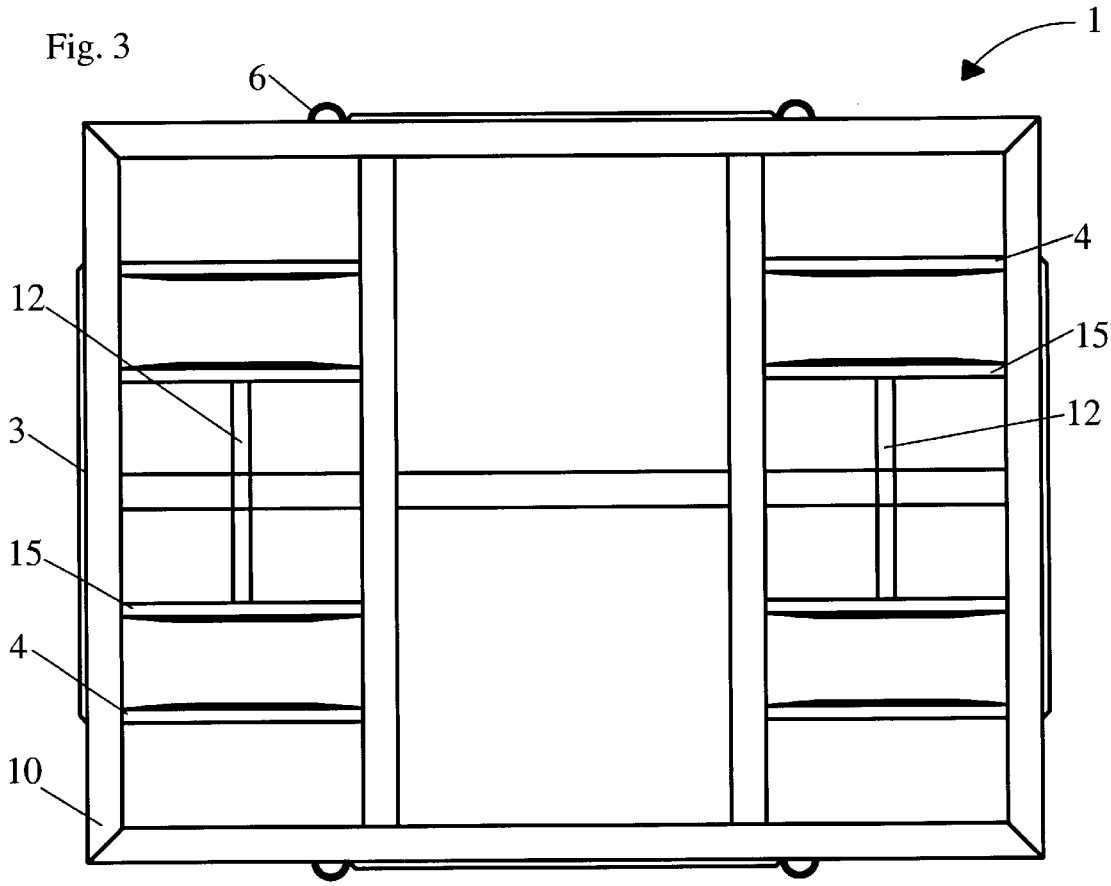
FIG. 3 shows a view of the base of the rectangular framework of a pallet of the present invention.

The surface of a platform (7), shown by the hatched lines, covers the top of a rectangular framework (10), depicted with the dotted lines (see also FIG. 3). The hollow bar member (4) is preferably welded to the top of the rectangular framework (10). The rectangular framework (10) is preferably composed of tubes or pipes made of mild steel, but the rectangular framework (10) may also be composed of materials including, but not limited to, a pressed mild steel metal sheet, aluminum, stainless steel, or lightweight materials including plastic or molded plastic. The platform (7) is preferably made of a sheet of metal such as mild steel, but other materials including, but not limited to, aluminum, wire mesh, plywood, plastic or cardboard can also be used. By utilizing a metal sheet, the platform (7) is more durable and long-lasting than the platforms in the prior art. A metal sheet platform (7) also eliminates the need to have other materials such as plywood or plastics to cover the platform (7). The combination of the platform (7) and the rectangular framework (10) comprise the base (11). Rings (6), for example half moon rings or O-rings, at the base of the rectangular framework (10) allow rubber blocks to be strapped across the pallet (1) from both sides. These rings (6) are preferably located at any position along the width or length of the rectangular framework (10).

An angular bar member (3) is preferably attached to the rectangular framework (10) of the base (11) on all four sides of the pallet (1) and serves as the border of the pallet (1). A very narrow nesting gap is created when the bottom border of the angular bar member (3) of a second pallet is resting on the top border of the angular bar member (3) of a first pallet. The base (11) is concealed by the height of the angular bar member (3). This minimizes the dead height in the apparatus, thus, maximizing the number of returning pallets in a 20-foot container. Also, when the pallet is in use, the angular bar member (3) border prevents the rubber blocks from sliding and holds the rubber blocks in place within the pallet (1) parameter.

The angular bar member (3) is preferably composed of metal or pressed metal, with an angle greater or equal to 90° so that the angular bar member (3) effectively conceals the rectangular framework (10). Other materials which could be used to manufacture the angular bar member (3) include, but are not limited to, aluminum, durable plastics, stainless steel, and copper. In a preferred embodiment, the angular bar member (3) is made of mild steel in 25 mm×25 mm dimensions and makes a 90° angle. One can also adopt a tapering concept of nesting. As the angle of the angular bar member (3) increases in the range of 90° to 180°, the angular bar member (3) becomes more tapered, and nesting of the pallet becomes easier. For example, an angular bar member (3) having an angle of 125° still functions as a border. Dead height is no longer an issue because the rectangular framework of an upper pallet nests on top of a rectangular framework of a lower pallet.

In an alternative embodiment, the angular bar member (3) border is left out and the pallet functions the same way as a wooden pallet without a border would. In this embodiment, rings (6) are placed on all four sides of the rectangular framework (10) to replace the border. For example, there are eight rings (6) around the rectangular framework (10). When rubber bale consolidation is completed, the rings (6) allow rubber blocks to be strapped across the pallet from any point along the width and length of the rectangular framework (10). The rubber blocks are held in position within the pallet parameter without the required border. However, the presence of an angular bar member (3) border is preferred because it prevents the rubber blocks from sliding off the pallet (1).

Nesting of an empty pallet (1) is possible when the flip members (2) are in the unextended position. Empty pallets (1) can be nested in any configuration. For example, a set of 30 pallets, which is approximately chest height for easy manual retrieval and is constrained by the height of the 20-foot container on a return journey, is easily nested. Nesting empty pallets is preferably performed by a forklift truck. The openings at the four corners of the pallet, where there is no angular bar member (3), allow the forklift truck to perform the nesting and stacking function easily in any direction.

Figure 2:
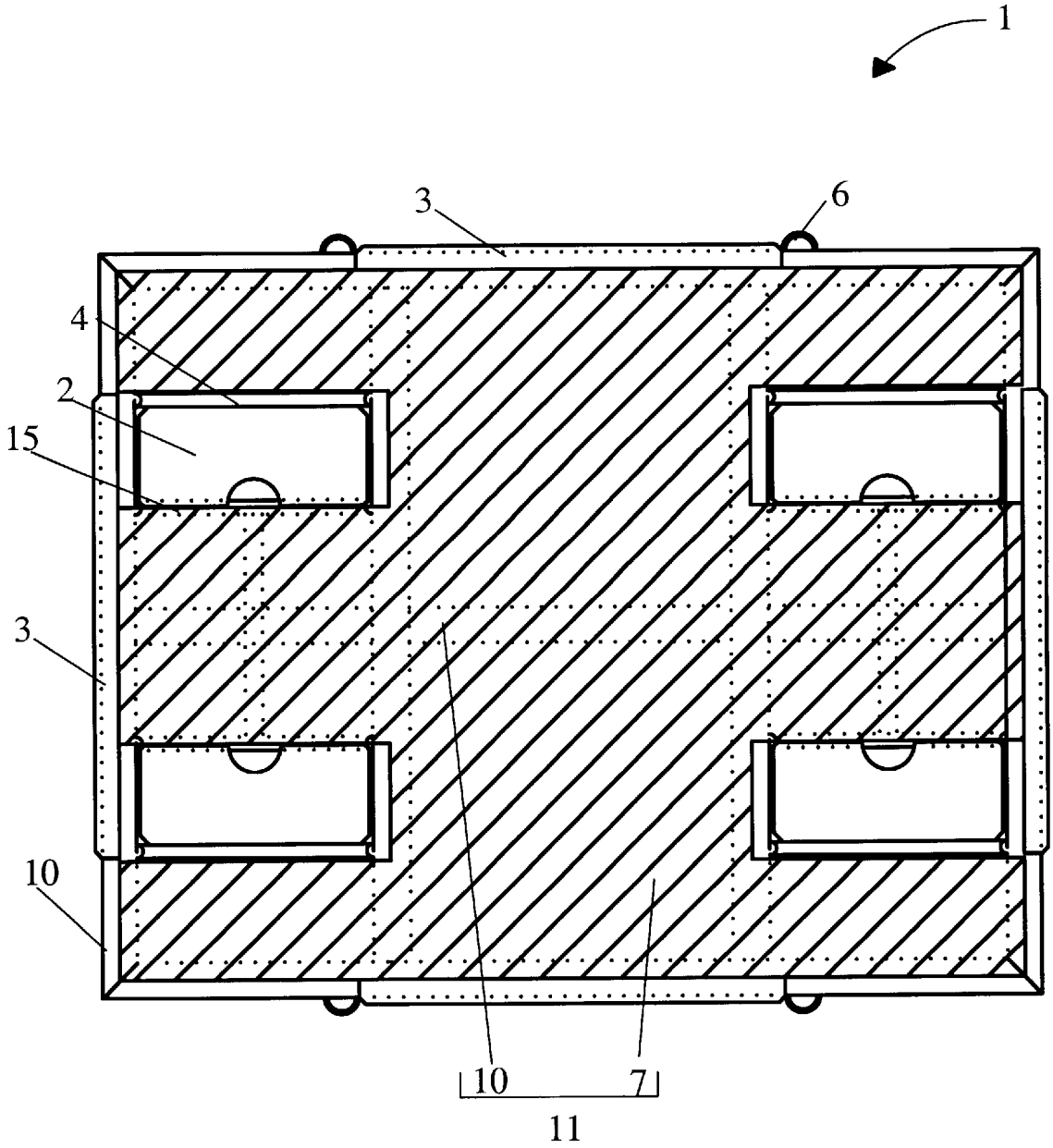
FIG. 2 shows a preferred embodiment of the pallet in a stacking configuration.
Figure 9:
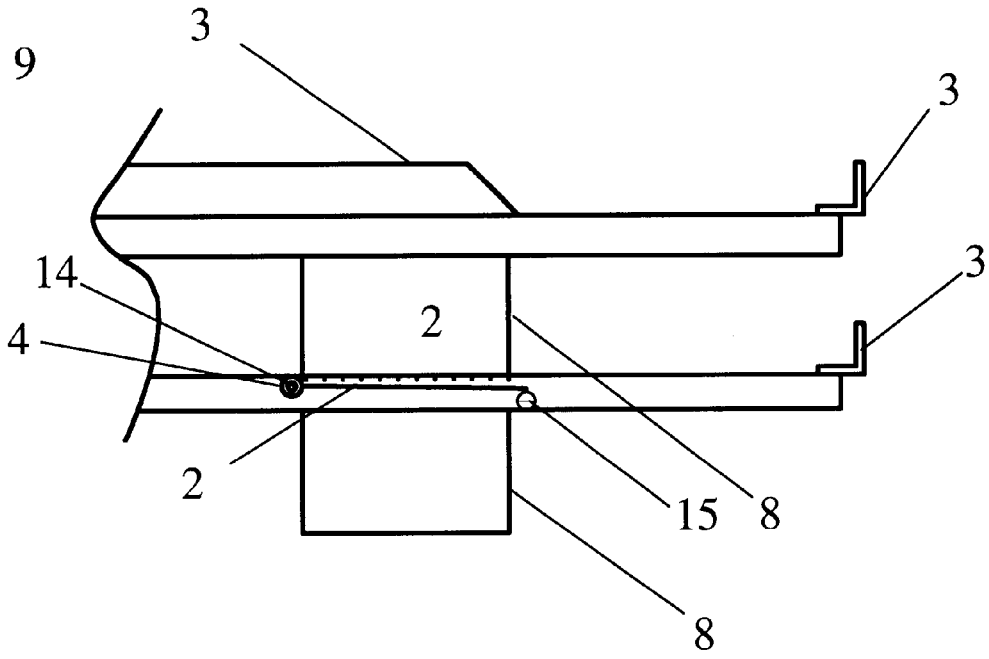
FIG. 9 shows a fragmented view of two stacked pallets with a leg in a locking position.

Referring also to FIGS. 2 and 9, the pallet (1) is stackable when the flip members (2) are flipped into an extended position, covering up the leg (8) cavities (9). In an alternative embodiment, instead of being rotated along the axis of the hollow bar member (4), the flip member (2) slides over the cavity (9) to cover it. Each of the hinges (16) acts as a foot to support members of the receiving pallet (1). A second bar member (15) is welded to a lower end of the rectangular framework (10). The bar member (15) is preferably a hollow tube or pipe. The edge of the flip member (2) rests on the second cylindrical member (15) when the flip member (2) is in the extended position. Bar members (4) and (15) also serve as a guide and glide the receiving pallet to slide in position during the nesting process. An alternative configuration of the flip member (2) is shown in FIG. 9. The flip member (2) has been rotated towards the corners or edges of the pallet (1) for stacking. When the flip member (2) in FIG. 9 is in the nesting configuration as described above, the flip member (2) is rotated towards the center of the pallet (1).

In a preferred embodiment, stacking is achieved in sets of 30 nested pallets. The hinges (16) facilitate stacking of a second set of 30 pallets on top of a first set (30 pallets) when the flip members (2) of the $30^{th}$ pallet (1) from the first set are in the extended position to receive the second set of 30 pallets (1). Also, the hinges (16) act as a part of the platform to prevent a rubber block from slipping into the leg cavity (9) when the flip members (2) are in the extended position. The hinges (2) add to the smoothness of the whole pallet platform. The task of stacking and retrieving the two sets of 30 pallets on top of each other is easily performed by a fork lift truck in any two width directions (see FIG. 6A). Ideally, two stacked sets of 30 pallets are loaded in a 20-foot container for a return journey. Each set of 30 nested pallets is easily manually retrievable.

Referring also to FIG. 3, the rectangular framework (10) is shown. Flat metal strips (12) of the rectangular framework (10) prevent the blade of a forklift truck from damaging the platform (7) surface during lifting.

Figure 4A:
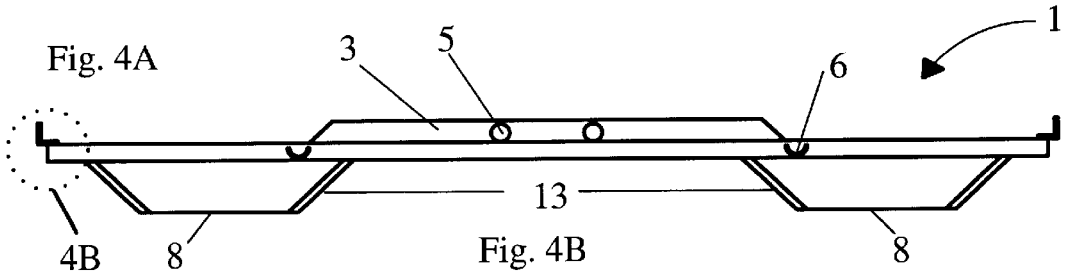
FIG. 4A shows a side view along the length of a single pallet of the present invention.
Figure 4B:
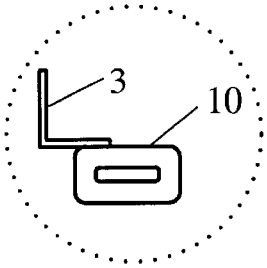
FIG. 4B shows a close up view of a corner of the pallet shown in FIGS. 4A and 5.
Figure 5:
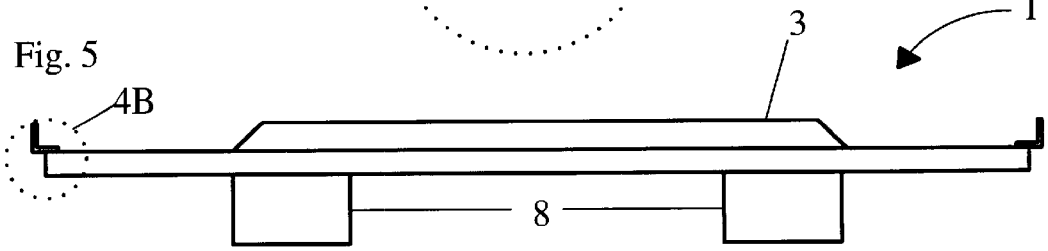
FIG. 5 shows a side view along the width of a single pallet of the present invention.

FIGS. 4A and 4B show that the angular bar member (3) preferably has holes (5). Although the holes are shown along the length of the pallet (1) in the figures, the holes (5) can be along the width or the length of the pallet (1). These holes (5) allow manual lifting by hands using hooks on both sides. FIG. 5 shows a view along the width of a single pallet (1).

Figure 6A:
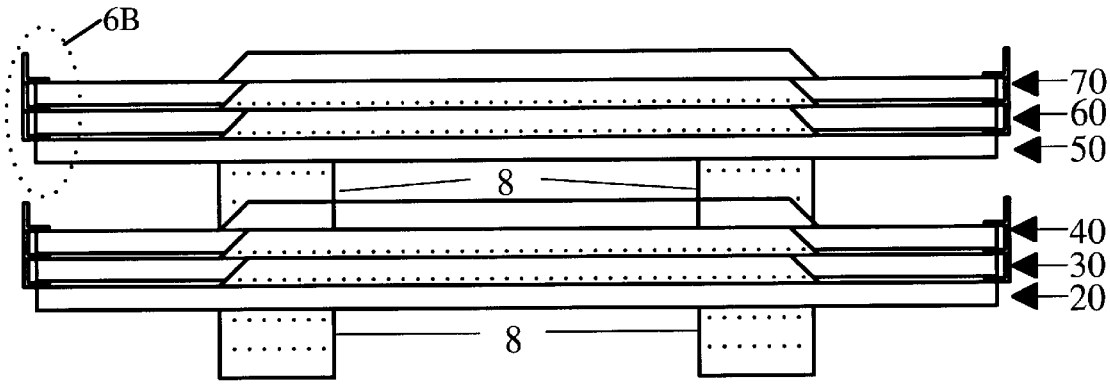
FIG. 6A shows a side view along the width of multiple pallets of the present invention in a nestng and stacking configuration.
Figure 6B:
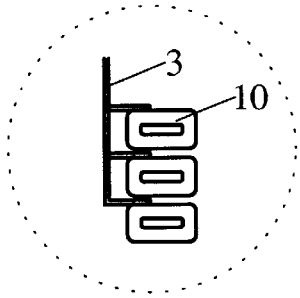
FIG. 6B shows a close up view of a corner of the pallet shown in FIGS. 6A and 7.
Figure 7:
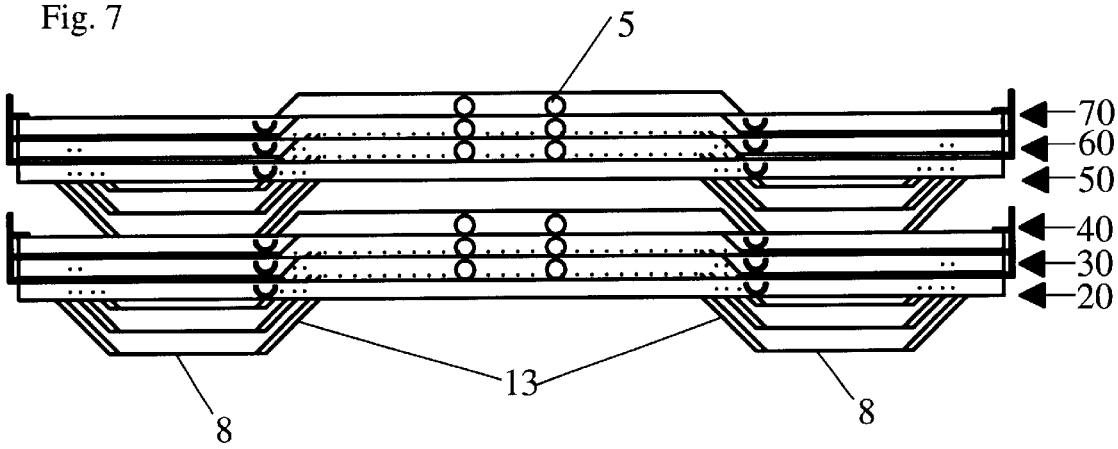
FIG. 7 shows a side view along the length of multiple pallets of the present invention in a nesting and stacking configuration.

FIGS. 6A through 6B show a view along the width of multiple pallets in a nesting and stacking configuration. In this example, three pallets (20), (30), and (40) are nested within each other. A fourth pallet (50) is stacked on pallet (40). Two additional pallets (60) and (70) are then nested together with pallet (50). The nested and stacked pallets of FIG. 6A are shown along the length of the pallets in FIG. 7. The legs (8) of each of the nested pallets fit into the cavity (9) of the pallet directly below them. For example, the legs of pallet (30) fit into the cavity (9) of pallet (20).

The metal pallet is designed to replace a wooden pallet in shrinkwrapped packaging. The pallet (1) is easily packaged in shrinkwrap. Rubber bales are arranged and placed on the pallet platform (7). Then, they are pressed down to a pre-set level with the aid of a metal plunger and a metal performer. When the bale consolidation is completed, a polythene shrink film is placed over the rubber extending down to the upper portion of the pallet platform (7). The pallet is held together tightly by polythene shrink film.

The hinge (16) solves the problem with the Malaysian Rubber Board pallet, since pallets of the present invention can be nested and stacked in a set of 30 pallets or any other configuration. The novel pallet described here also preferably has a metal sheet platform (7). Unlike the wire mesh platform used in the Malaysian Rubber Board pallet, a metal sheet platform (7) does not require any other supporting materials such as plastics or plywood to cover the platform (7). Also, the height of the angular bar member (3) conceals the height of the rectangular framework (10) for an improved pallet (1). Hence, 45% more of the novel pallets of the present invention can be loaded in a 20-foot container on a return journey compared to the Malaysian Rubber Board pallet.

A metal pallet has a number of advantages over a wooden pallet. A metal pallet allows nesting and stacking, is durable and long-lasting, and is free of contaminating wooden splinters. There are no problems disposing of the pallet because it is recyclable, thus making it environmentally friendly. The pallet is preferably used to transport rubber blocks. Alternatively, it is used to transport any non-perishable cargoes in bulk.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A pallet comprising:

a) a base comprising:

i) a framework having a width and a length defining a shape of said base; and ii) a platform covering a top of said framework;

b) a plurality of hollow legs connected to said base, wherein said hollow legs comprise an open top and side walls extending downwardly from a top surface;

c) a plurality of cavities formed by the hollow legs wherein legs of a second pallet fit into said cavities when said cavities are exposed;

d) a plurality of thin, flat hinged flip members, one hinged flip member for each cavity, wherein a pivot of each hinged flip member is located along a side of said top of each leg, such that when said hinged flip member is rotated into a first position, said hinged flip member exposes a cavity, and when said hinged flip member is rotated into a second position, said hinged flip member covers said cavity; and e) an angular bar member along at least a portion of an outer perimeter of said framework having an angle approximately between 90 degrees and 180 degrees;

such that when the flip members are in the first position, the hollow legs of a pallet can fit into the cavities of a nesting pallet below without the flip members adding to a nesting height of a plurality of nested pallets.

2. The pallet of claim 1, wherein said angular bar member has at least one hole wherein said hole allows manual lifting of the pallet using at least one hook.

3. The pallet of claim 1, wherein said pallet is in a nesting configuration when said hinged flip member is in said first position.

4. The pallet of claim 1, wherein said pallet is in a stacking configuration when said hinged flip member is in said second position.

5. The pallet of claim 1, wherein said pallet is made of a material selected from the group consisting of:

a) metal;

b) molded plastic; and c) a combination of metal and molded plastic.

6. The pallet of claim 5, wherein said pallet is made of steel.

7. The pallet of claim 5, wherein said pallet is made of high-density polyethylene.

8. The pallet of claim 1, further comprising a plurality of rings along an outer perimeter of the rectangular framework, wherein said rings allow rubber blocks to be strapped across the pallet.

9. The pallet of claim 8, wherein said rings are selected from the group consisting of half-moon rings and O-rings.

10. The pallet of claim 1, wherein said legs further comprise a U-shaped channel along two parallel side walls of the legs.

11. The pallet of claim 1, wherein said legs have a thickness of approximately 3.0 to 5.0 mm.

12. The pallet of claim 1, wherein said cavities comprise channels.

13. A plurality of pallets disposed to be subdivided into a plurality of sets wherein each set having at least one pallet is stacked and nested for easy retrieval, each pallet comprising:

a) a base comprising:

i) a framework having a width and a length defining a shape of said base; and ii) a platform covering a top of said framework;

b) a plurality of hollow legs connected to said base, wherein said hollow legs comprise an open top and side walls extending downwardly from a top surface;

c) a plurality of cavities formed by the hollow legs wherein legs of a second pallet fit into said cavities when said cavities are exposed;

d) a plurality of thin, flat hinged flip members, one hinged flip member for each cavity, wherein a pivot of each hinged flip member is located along a side of said top of each leg, such that when said hinged flip member is rotated into a first position, said hinged flip member exposes a cavity, and when said hinged flip member is rotated into a second position, said hinged flip member covers said cavity; and e) an angular bar member along at least a portion of an outer perimeter of said framework having an angle approximately between 90 degrees and 180 degrees;

such that when the flip members are in the first position, the hollow legs of a pallet can fit into the cavities of a nesting pallet below without the flip members adding to a nesting height of a plurality of nested pallets.

14. The plurality of pallets of claim 13, wherein said angular bar member has at least one hole wherein said hole allows manual lifting of the pallet using at least one hook.

15. The plurality of pallets of claim 13, wherein said pallet is in a nesting configuration when said hinged flip member is in said first position.

16. The plurality of pallets of claim 13, wherein said pallet is in a stacking configuration when said hinged flip member is in said second position.

17. The plurality of pallets of claim 13, wherein said pallet is made of a material selected from the group consisting of:

a) metal;

b) molded plastic; and c) a combination of metal and molded plastic.

18. The plurality of pallets of claim 17, wherein said pallet is made of high-density polyethylene.

19. The plurality of pallets of claim 13, further comprising a plurality of rings along an outer perimeter of the rectangular framework, wherein said rings allow rubber blocks to be strapped across the pallet.

20. The plurality of pallets of claim 13, wherein said legs further comprise a U-shaped channel along two parallel side walls of the legs.

* * * * *